US006237608B1

(12) United States Patent
Kari

(10) Patent No.: US 6,237,608 B1
(45) Date of Patent: May 29, 2001

(54) FOIL DISPENSER APPARATUS AND METHOD

(76) Inventor: Ollie Kari, 85 Loveless La., Northbridge, MA (US) 01534

( * ) Notice: Subject to any disclaimer, the term of this patent is extended or adjusted under 35 U.S.C. 154(b) by 0 days.

(21) Appl. No.: 09/023,443

(22) Filed: Feb. 13, 1998

Related U.S. Application Data

(63) Continuation of application No. 09/005,208, filed on Jan. 9, 1998, now abandoned, which is a continuation-in-part of application No. 08/927,516, filed on Sep. 11, 1997, now abandoned.

(51) Int. Cl.[7] ..... A61K 7/13; A61K 7/135
(52) U.S. Cl. ..... 132/208; 132/200
(58) Field of Search ..... 132/208, 222, 132/200; 225/21, 53, 43, 77, 19, 54, 52; 242/595

(56) References Cited

U.S. PATENT DOCUMENTS

| | | | | |
|---|---|---|---|---|
| 1,238,278 | * | 8/1917 | Dulle | 225/42 |
| 2,116,079 | * | 5/1938 | Moulin | 225/43 |
| 2,626,761 | * | 1/1953 | Simpson et al. | 225/42 |
| 2,683,641 | * | 7/1954 | Larson | 225/53 |
| 2,751,163 | * | 6/1956 | Waltz | 225/42 |
| 2,878,980 | * | 3/1959 | Waltz | 225/42 |
| 3,050,224 | * | 8/1962 | Drolshammer | 225/43 |
| 3,707,251 | * | 12/1972 | Dashnier et al. | 225/21 |
| 3,749,105 | * | 7/1973 | Sestita | 132/208 |
| 4,579,267 | * | 4/1986 | Planke | 225/54 |
| 4,655,377 | * | 4/1987 | Orangeo, Jr. et al. | 132/208 |
| 4,787,542 | * | 11/1988 | Ruff et al. | 225/1 |
| 4,991,738 | * | 2/1991 | Peterson | 221/1 |
| 5,549,232 | * | 8/1996 | Scholfield | 225/77 |

* cited by examiner

*Primary Examiner*—Gene Mancene
*Assistant Examiner*—Pedro Philogene
(74) *Attorney, Agent, or Firm*—Nields & Lemack

(57) ABSTRACT

Dispenser and method for dispensing sheets of material, particularly metallic foil. The dispenser houses the metallic foil in roll form, the foil having a free end which can be grasped by the beautician, cut to the appropriate length by a cutting blade, for example coupled to the dispenser housing, and applied to the hair in the conventional manner. In one embodiment of the invention, the dispenser also supports one or more containers for coloring solution or other liquids useful for the application.

18 Claims, 12 Drawing Sheets

FOIL DISPENSER APPARATUS AND METHOD

This application is a continuation of Ser. No. 09/005,208 filed Jan. 9, 1998 now abandoned which is a continuation in part of Ser. No. 08/927,516 filed Sep. 11, 1997 now abandoned.

BACKGROUND OF THE INVENTION

The present invention is directed towards a dispensing apparatus for metallic foil or the like, particularly applicable to that used by beauticians and hair stylists to color or highlight hair.

Several conventional processes having been in use for selectively coloring or highlighting hair. In one prior art process, a perforated cap is placed on the subject's head, with one or more locks of hair pulled through the various perforations in order to segregate them from the remainder of the hair under the cap. These selected locks of hair can then be colored by a conventional hair coloring procedure, such as by painting with hair coloring or bleaching solutions.

Another more recent approach is with the use of metallic foil, typically aluminum foil. With this procedure, the beautician isolates a lock of hair to be colored, and places the isolated lock on a pre-cut strip of foil. The hair coloring solution is then applied to the lock of hair supported on the foil such as by painting, and the treated lock of hair is then wrapped in the foil for a period of time so that the hair coloring solution can take effect. This procedure is then repeated with further locks of hair, until the desired amount of hair has been treated. In this manner, hair can be highlighted (e.g., a gradient of color from lighter to darker can be obtained), colored, bleached, etc.. Wax paper can also be used instead of metallic foil.

However, it is readily apparent that the foregoing procedure is tedious, cumbersome and time consuming. Generally the foil or paper used must be pre-cut into strips of the appropriate size, and laid out for the beautician so that they are readily accessible during the coloring procedure. In addition, where multiple colors are employed in a single coloring operation, the containers or bowls housing these liquid coloring solutions have a tendency to spill.

Accordingly, it would be desirable to provide apparatus and a method for successively dispensing metallic foil or paper, thereby providing ready and easy access to the foil or paper without pre-cutting.

SUMMARY OF THE INVENTION

The problems of the prior art have been overcome by the present invention, which provides a dispenser and method for dispensing sheets of material, particularly metallic foil. The dispenser houses the metallic foil in roll form, the foil having a free end which can be grasped by the beautician, cut to the appropriate length by severing means coupled to the dispenser housing, and applied to the hair in the conventional manner. In one embodiment of the invention, the dispenser also supports one or more containers for coloring solution or other liquids useful for the application.

DETAILED DESCRIPTION OF THE INVENTION

Figure 1:
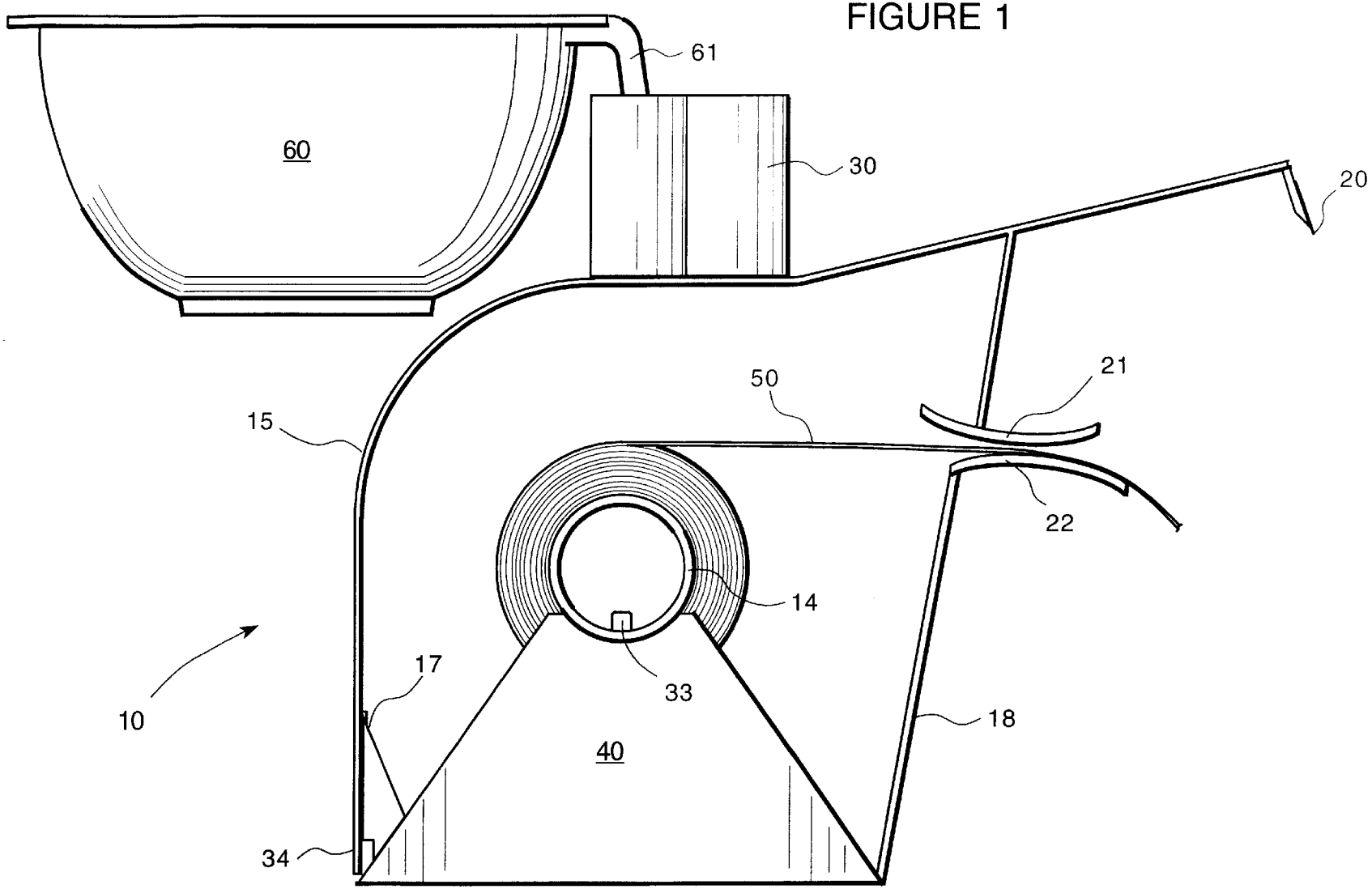
FIG. 1 is a side view of one embodiment of the present invention.
Figure 2:
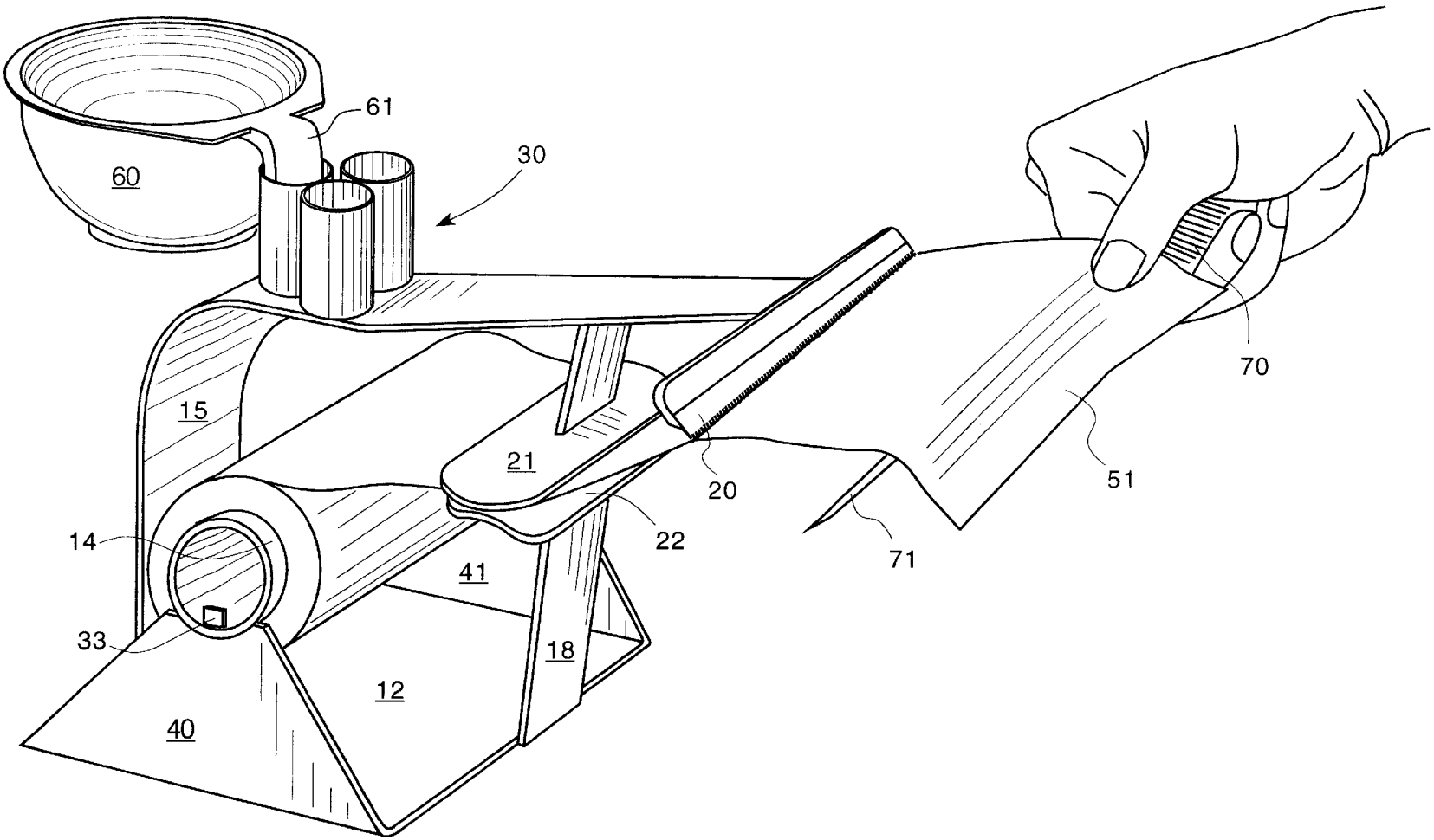
FIG. 2 is a perspective view of the embodiment of FIG. 1.

Turning first to FIGS. 1 and 2, there is shown one embodiment of the dispenser apparatus 10 of the present invention. The dispenser is particularly useful in dispensing metallic foil, preferably aluminum foil, in such a manner that the beautician can selectively size each individual piece by appropriately severing each individual piece from the main roll. Those skilled in the art will recognize that other sheet materials, such as wax paper, could also be used. The size and grade of the metallic foil is not particularly limited and will depend upon the particular application, but generally is between about 5–7 mils thick.

The dispenser 10, which is preferably made of steel, includes a base portion 12 having opposite side walls 40, 41 on which the metallic foil roll is rotatably mounted. In the embodiment shown, the metallic foil 50 is provided in a rolled-up fashion on a hollow cylindrical core. A cylinder 14 having an outside diameter smaller than the inside diameter of the hollow cylindrical core is adapted to be received by the hollow cylindrical core, the core being able to rotate about the cylinder 14 simply by pulling the free end of the foil 50. The cylinder 14 at its respective longitudinal ends is preferably removably fixed to the base portion 12. The manner in which the cylinder 14 is so coupled is not particularly limited, as long as the cylinder can be readily removed so that the roll of metallic foil can be easily inserted over the cylinder. The preferred means of coupling the cylinder 14 to the base 12 is by providing apertures or slots at the respective longitudinal ends of the cylinder 14, the slots be sized and shaped to receive corresponding pins 33 projecting from the base 12, and more particularly, from the side walls 40, 41. The hollow cylindrical core of the foil roll can also terminate at one or both of its longitudinal ends in a shape keyed to fit into a corresponding shape associated with the base 12 or side walls 40, 41.

Extending from the rear of the base portion 12 is a support arm 15. Preferably the support arm 15 is hinged to the base 12 via hinge mechanism 34 so that the arm 15 can be moved, thereby allowing unobstructed access to the cylinder 14 in order to install or remove the metallic foil roll from the apparatus. A stop 17 is provided coupled to base 12 so that the support arm 15 always returns to the same operative position relative to the foil roll, as shown in FIG. 1. The support arm can be locked in this position by any suitable means, such as a screw or latch (not shown). The support arm 15 terminates at its end distal from the base portion 12 in a severing device 20, preferably a sharped-tooth strip having a plurality of teeth, preferably ranging from about 15 to about 50 teeth per inch. Preferably the severing device 20 is positioned at an angle of greater than 0° and less that 90° relative to horizontal, more preferably between about 75° and 89° relative to horizontal, most preferably about 85–87° relative to horizontal, thereby facilitating severing of the metallic foil in an upward motion relative to the location of the foil roll, as shown in FIG. 2. So positioning the severing device 20 also minimizes the possibility of injury to the operator of the device, as the sharp teeth of the severing device 20 are pointed downward.

Optionally extending from support arm 15 between its two ends is guide plate 21. Preferably the guide plate 21 is beveled to form a convex surface to facilitate guiding of the metallic foil 50. Extending vertically from the front portion of the base 12 is an optional front support arm 18. The front support arm 18 supports a second guide plate 22, which in cooperation with guide plate 21, assist in directing the foil 50 during the dispensing operation, and over which the metallic foil 50 rests when the dispenser is not in operation. Preferably the guide plate 22 is also beveled to form a convex surface to facilitate guiding of the metallic foil 50. Guide plates 21 and 22 are positioned so as to form therebetween a nip slightly larger than the thickness of the metallic foil. The guide plates are preferably offset as shown, with either the top plate 21 or the bottom plate 22 being closer to the metallic foil roll than the other, so that the nip is formed therebetween at an upward angle in the same general direction as the foil is being pulled by the user. The nip also minimizes the tendency of the foil 50 to roll back onto the foil roll when not in use. The stop 17 ensures that the positioning of guide plate 21 relative to guide plate 22 is constant, thereby ensuring that the size and location of the nip is constant.

The severing device 20 is preferably positioned at a suitable distance from and a suitable height with respect to the metallic foil roll so as to easily enable the operator to sever each piece of foil at the desired length. Positioning the severing device too close to the roll, either in the vertical or horizontal direction, will hinder the ability of the operator to cut a piece of foil at the appropriate length. Preferably the severing device 20 extends a distance of about 5–7 inches, most preferably about 5.5 inches, in the horizontal direction from the center of the cylinder 14, and is about 5–6 inches above the base 12 and preferably extends a distance of about 2–4 inches, preferably about 3 inches, in the vertical direction from the center of the cylinder 14.

Support arm 15 can optionally include means for supporting one or more mixing bowls 60. To that end, FIGS. 1 and 2 show a plurality of hollow tubes 30 coupled to the top of support arm 15. The inner diameter of each hollow tube is sufficient to receive the handle 61 of a bowl 60, and is deep enough to stabilize and support the weight of the bowl 60 in a substantially horizontal position even when filled with liquid. As shown in FIG. 2, the plurality of hollow tubes is substantially centrally located relative to the base, thereby minimizing the additional space necessary to accommodate the mixing bowls 60. In addition, since the mixing bowls are elevated from the base, valuable counter or cart space is not unnecessarily occupied by the mixing bowls.

Figure 3:
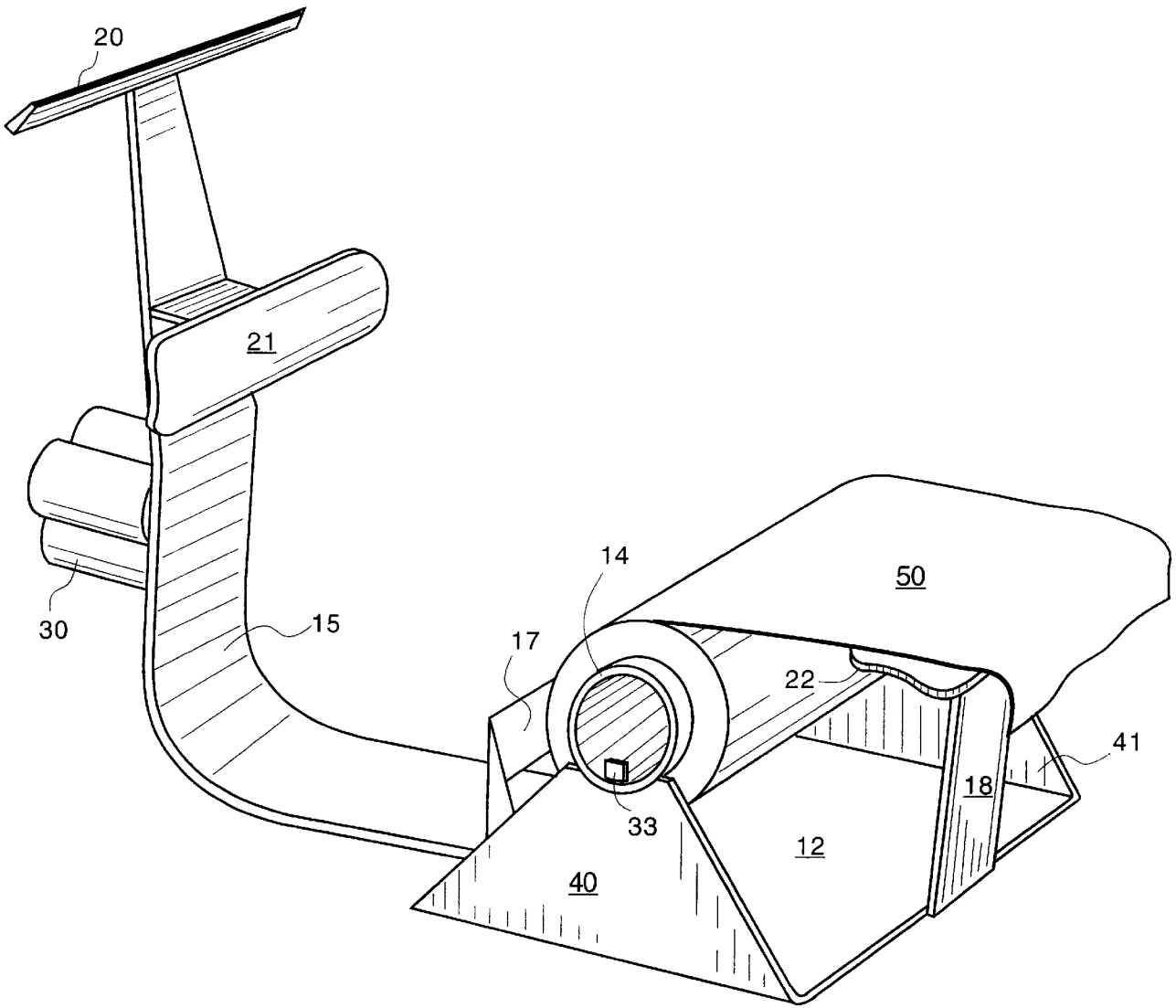
FIG. 3 is a perspective view of the embodiment of FIG. 1 in an open or install position.
Figure 8:
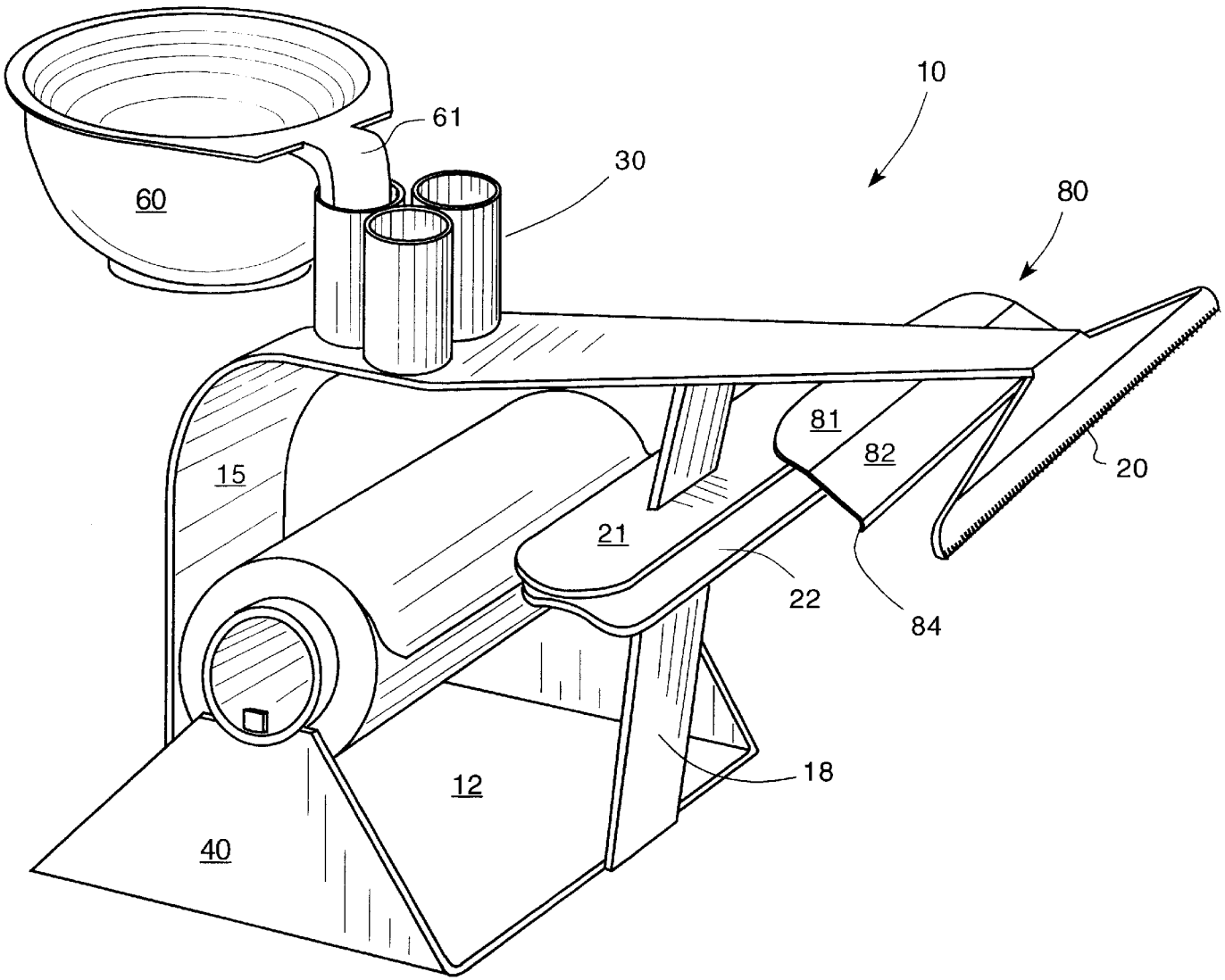
FIG. 8 is a perspective view showing a further improvement of the embodiment shown in FIG. 1.
Figure 9:
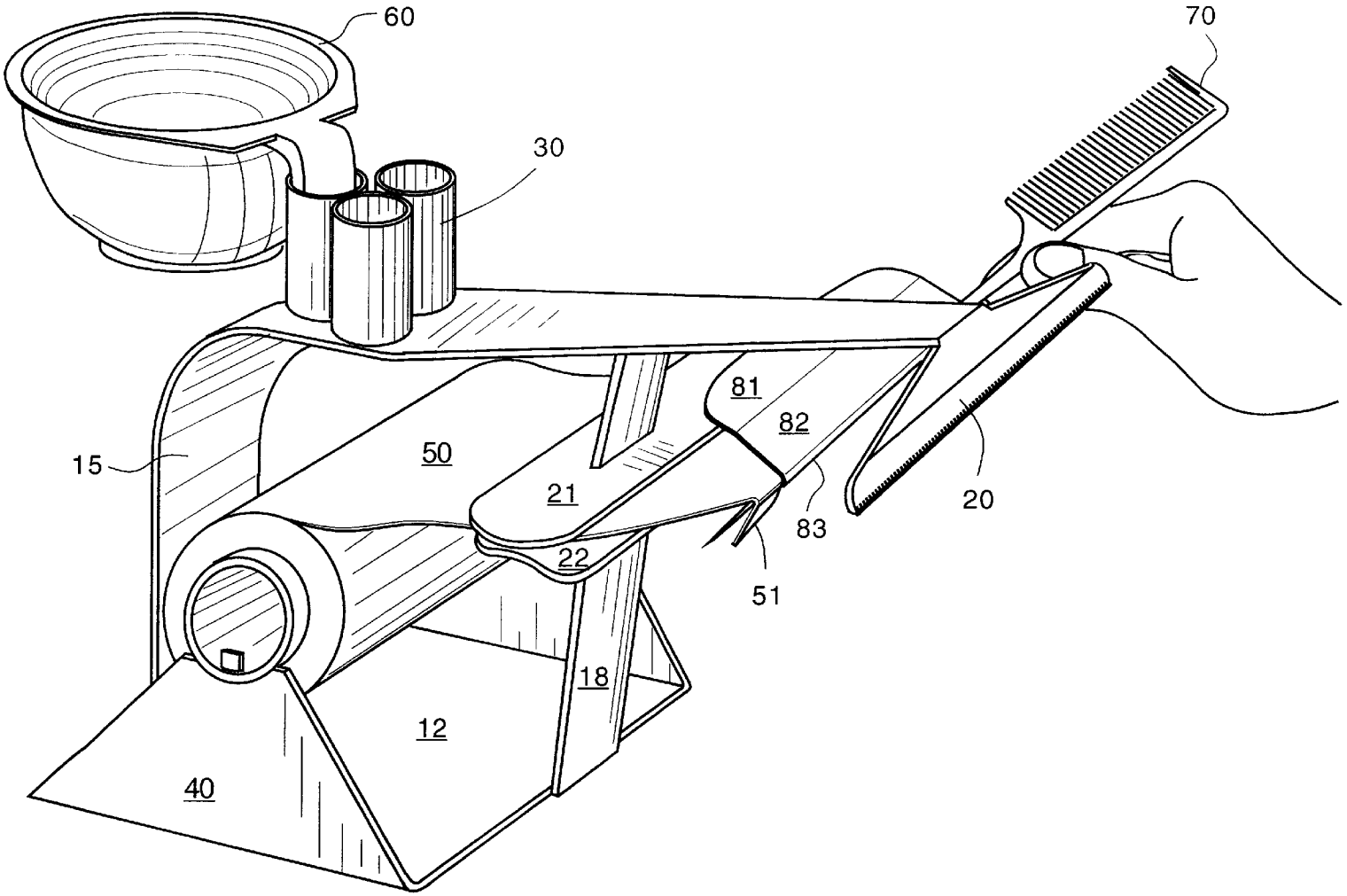
FIG. 9 is a perspective view showing the embodiment of FIG. 8 in use.
Figure 10:
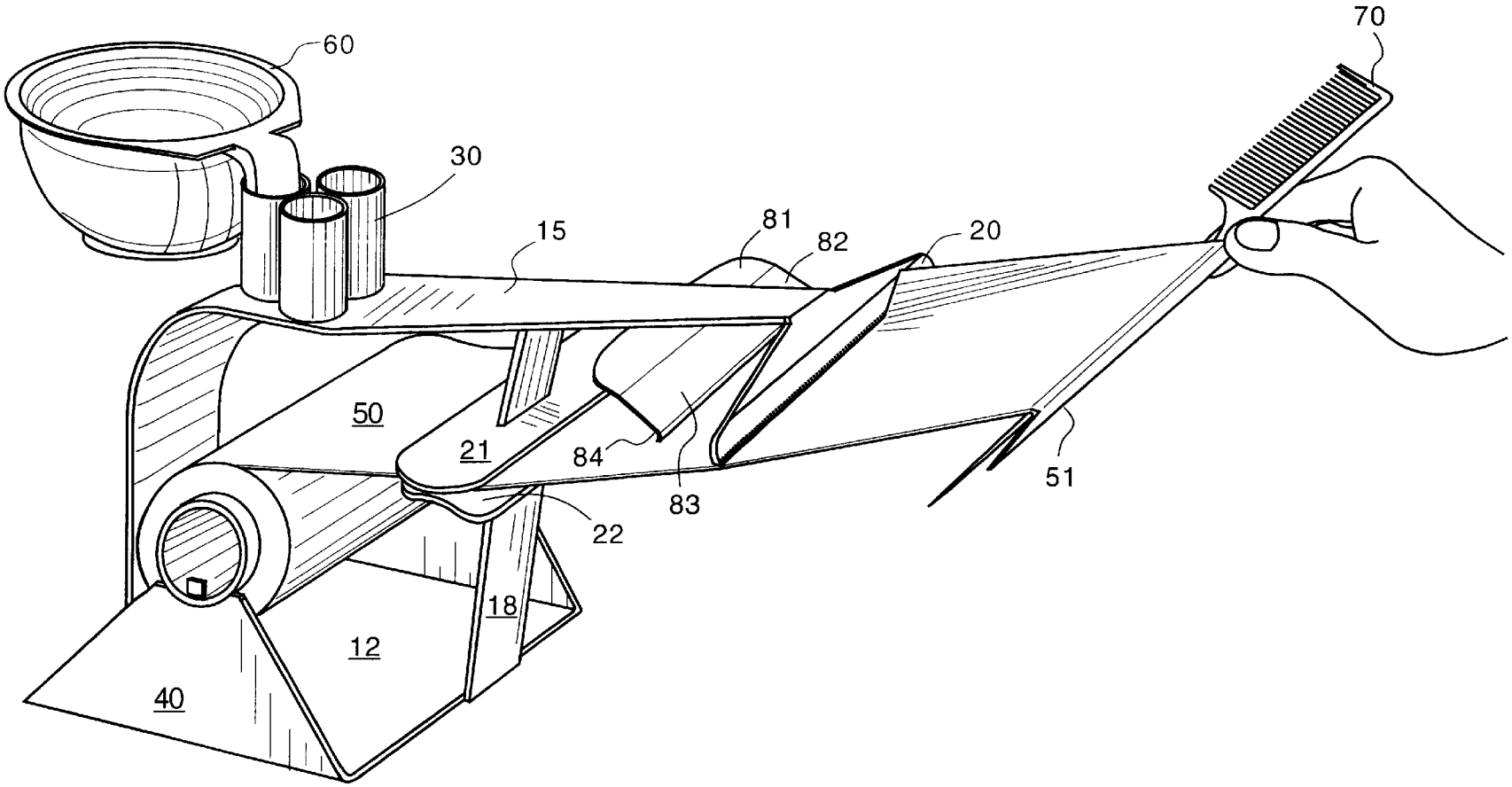
FIG. 10 is a perspective view showing the embodiment of FIG. 8 in use.

FIGS. 8–10 illustrate an improvement of the embodiment of FIGS. 1–3. Specifically, foil folding means 80 is strategically located with respect to the severing device 20 so as to assist in folding the foil about the tail of a rat tail comb. One suitable means of so locating the foil folding means 80 is by fixing it underneath support arm 15 by any suitable means, such as welding. Alternatively, the foil folding means 80 could extend from the same portion of support arm 15 that holds the severing device 20. The foil folding means 80 is preferably a beveled plate, with portion 81 being coupled to the support arm 15, and beveled portion 82 extending from portion 81 towards severing device 20 both in the horizontal and vertical direction. Beveled portion 82 terminates in a downwardly extending angled flange 83, thereby forming a notch 84 at the intersection between beveled portion 82 and the flange 83. Preferably the notch 84 is curved so as to facilitate receipt of the generally cylindrical tail of a rat tail comb. The angle and length of the beveled portion should be such so as to ensure that the notch 84 is positioned above (in the vertical direction) the severing device 20. Preferably the notch 84 is about 1/16–1/8 of an inch above the severing device 20, and about 0.75–1.25 inches, preferably about 1 inch, behind the severing device 20 (in the direction towards roll 50). The distance between the notch 84 and the severing means 20 will define the amount of the sheet material that is folded about the tail of the comb 70. The width of foil folding means 80 is preferably thinner than the width of the foil 50. For example, where 5 inch wide foil 50 is used, the width of the portion 81, beveled portion 82 and flange 83 is 4 inches in order to allow easy access thereto.

FIGS. 9 and 10 illustrate the operation of the foil folding means 80. The tail of a rat tail comb is positioned underneath the free end of the foil 50. Together with a rat tail comb 70, the free end of the foil 50 is then grasped (such as with the middle finger of the user; the index finger and thumb of the user being used to hold the comb 70 as shown in FIG. 9) at a point about 1 inch from the free end and directed up towards the notch 84. The tail of the comb 70, now with the foil wrapped around it, is brought into contact with the notch 84, creasing the foil 50 about the tail of the comb 70 as shown. This helps minimize slippage of the foil about the comb as the operation continues. The comb is then lowered to a position slightly below the severing device 20, and then brought outwardly past the severing device 20 as shown in FIG. 10, pulling the foil 50 with it. Once the desired length of foil 50 is achived, an upward motion is then used to sever the foil against the severing device 20 as shown.

Figure 4:
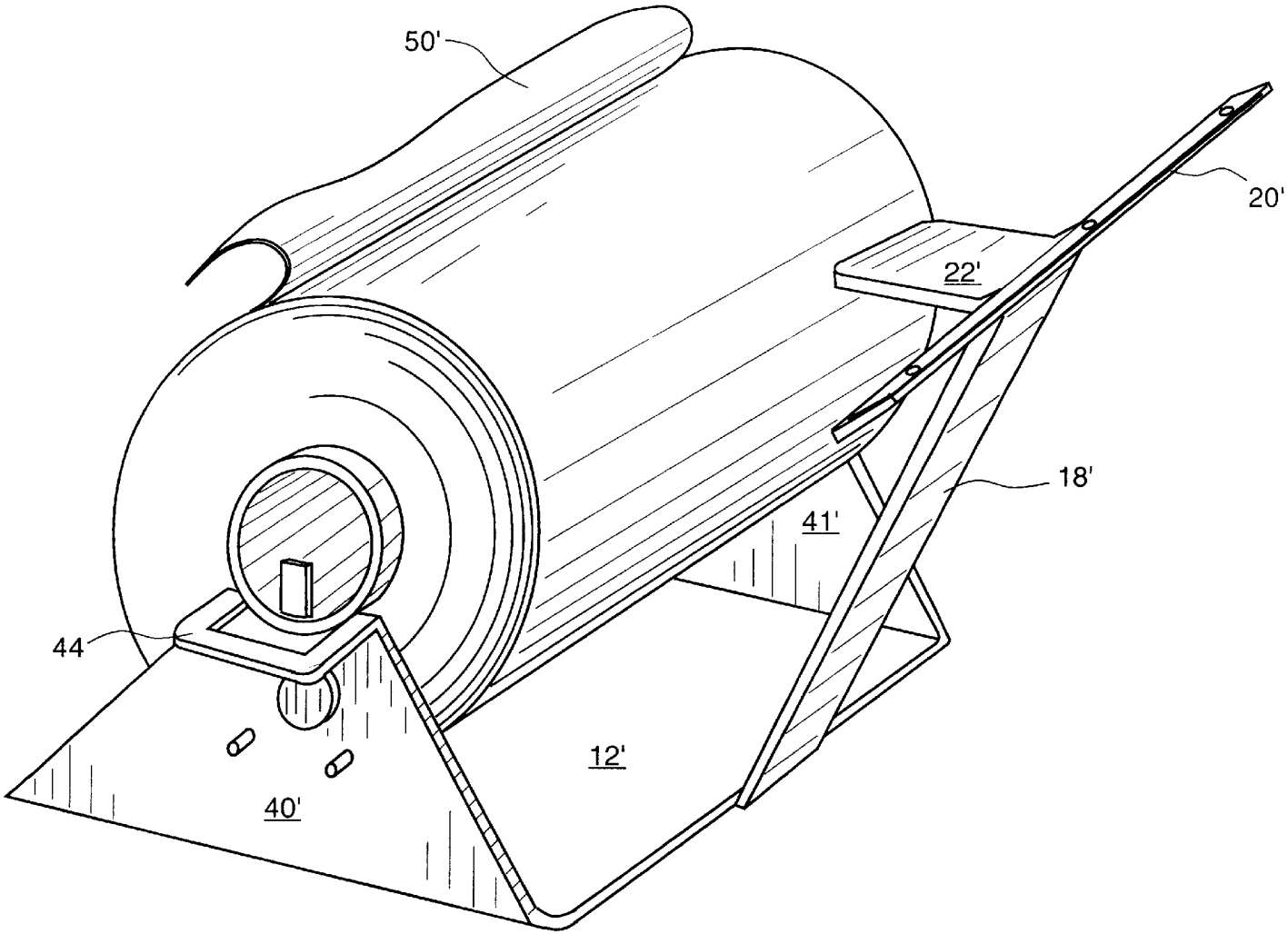
FIG. 4 is a perspective view of a second embodiment of the present invention.
Figure 5:
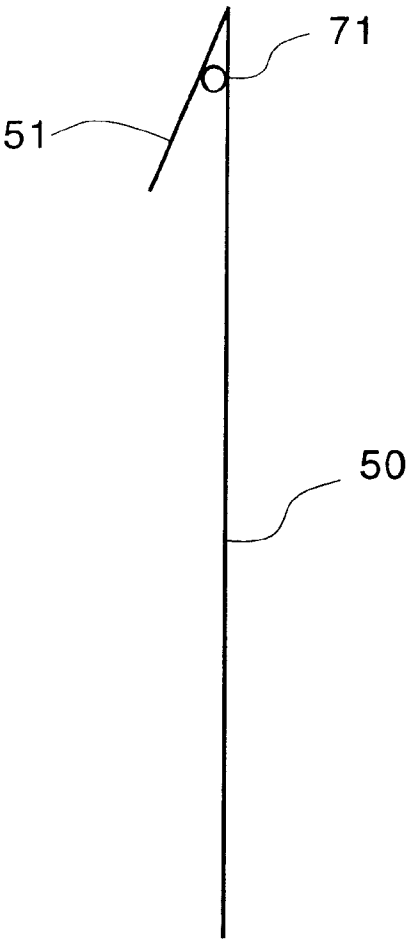
FIG. 5 is a side view of the sheet material as wrapped around a comb upon dispensing from the apparatus.

FIG. 4 shows a second embodiment of the present invention. A base portion 12' is similar to the base portion 12 of the first embodiment, and includes opposite side walls 40', 41' on which the metallic foil roll is rotatably mounted. A front support arm 18' extends from the base portion 12', preferably at an angle (about 60° relative to horizontal), and terminates at its end distal from the base portion in a severing device 20' having a plurality of sharp teeth as described above. The severing device 20' is positioned at an upward angle of greater than 0° and less than 90° relative to horizontal, preferably 30–50° relative to horizontal more preferably about 40° relative to horizontal. Extending substantially horizontal from the support arm 18' just below the severing device 20 is a resting plate 22' on which the metallic foil 50' rests when the device is not in operation. The resting plate 22' helps prevent the free end of the foil 50' from falling towards the base portion or from its tendency to roll back on the roll of foil, thereby facilitating its access to the operator when the next piece is desired. Alternatively, the guide plates 21 and 22 could be employed in the device of this embodiment, such as by the addition of support arms analogous to arms 15 and 8 of FIGS. 1 and 2.

The opposite side walls 40', 41' include flanges 44 into which the handles of the mixing bowls can be removably stabilized or secured.

Figure 6:
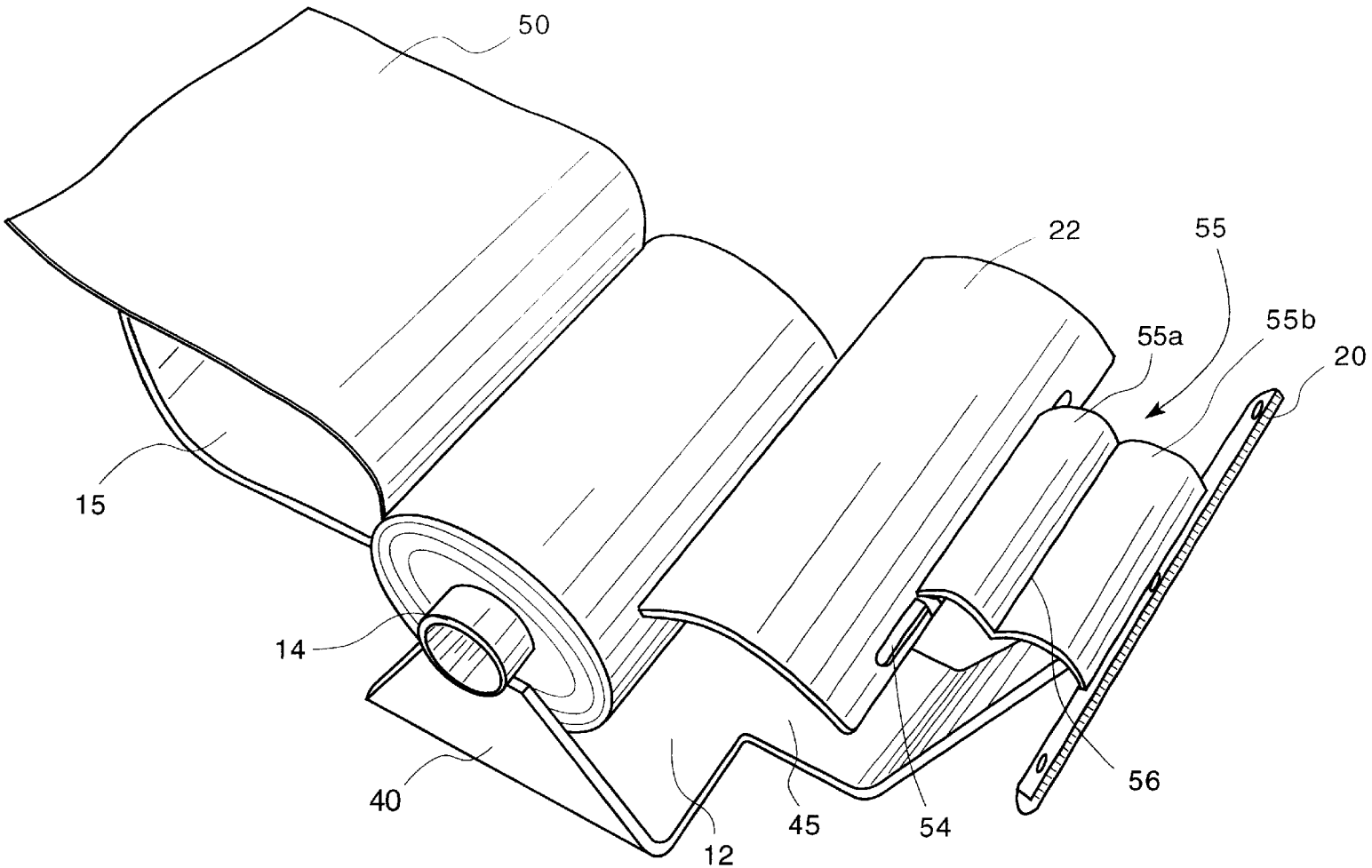
FIG. 6 is a perspective view of a third embodiment of the present invention.
Figure 7A:
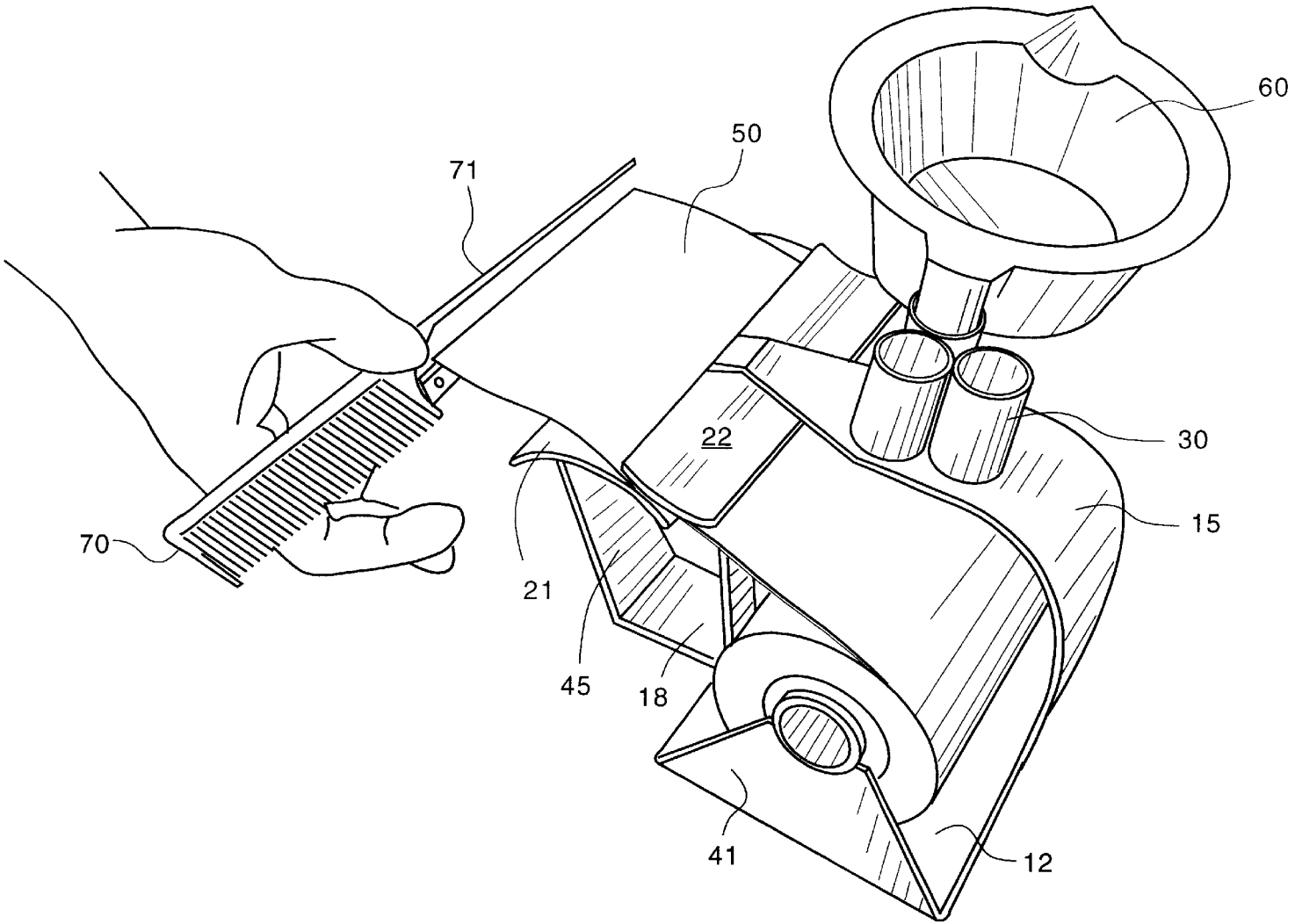
FIGS. 7A, 7B and 7C are perspective views showing three steps in carrying out the method using the device of the present invention.

FIGS. 6 and 7A, B and C show a third embodiment of the present invention, and can best be described as a hybrid of both the first and second embodiments. Specifically, it is similar to the embodiment of FIG. 1 in that it includes first and second offset guide plates 21 and 22, as well as support arm 15 having a plurality of hollow tubes 30 (not shown) for supporting mixing bowls 60, and base portion 12 with side walls 40 and 41. It differs from the FIG. 1 embodiment in that the severing device 20 is not coupled to the support arm 15, but rather to a separate angled arm 45 extending outwardly and upwardly from the base portion 12 in front of front support arm 18 that supports guide plate 22. The severing device 20 is angled upwardly as in the embodiment of FIG. 4, which requires that the sheet material be torn with a downward force as in the embodiment of FIG. 4.

Situated between guide plate 22 and severing device 20 is a detent mechanism 55, which serves a purpose similar to the foil folding means 80 of the embodiment of FIG. 8. The detent mechanism 55 can be attached to the apparatus by any suitable means, such as by welding to guide plate 22. It can also be movable and removable, such as by attachment in an optional slot 54 formed near the edge of guide plate 22. This movability feature allows the detent mechanism to be appropriately positioned more toward the left or right of the apparatus, depending upon whether the stylist is left-handed or right-handed, or in the center if desired. In the preferred embodiment, the detent mechanism is permanently fixed to the guide plate 22 and is centrally located relative to the width of the guide plate 22 or severing means 20. The detent mechanism 55 is shaped so that a nadir or indent 56 is formed along its width. This indent 56 is preferably located about 1 inch behind the severing means 20 (toward the guide plate 22), and provides a resting place for the tail of a rat tail comb 60 (FIG. 7B) as the stylist is set to grasp the foil 50 positioned over the mechanism 55. The indent 56 facilitates the proper placing of the comb over the foil, advantageously also creating a crease in the foil about which the foil can be folded onto the comb once severed from the roll. In the embodiment shown, the detent mechanism 55 includes two convex surfaces 55*a* and 55*b*, positioned before and after the indent 56 (in the direction toward severing device 20). The shape of these surfaces causes the tail of the rat tail comb to be guided into the indent 56 even if initially placed in a crooked fashion or not directly in the indent. Other suitable shapes accomplishing the same goal could be used, such as sloped portions together forming a triangle or "V" shape.

In either the embodiment of FIGS. 1, 4 or 6, the base 12 could be readily modified to accommodate a plurality of separate rolls of sheet material 50, each being a different thickness and/or color. Different colored sheet material can be used by the beautician to mark different locks of hair in order to identify different colors applied to different locks, or degrees of shading thereof.

Figure 7B:
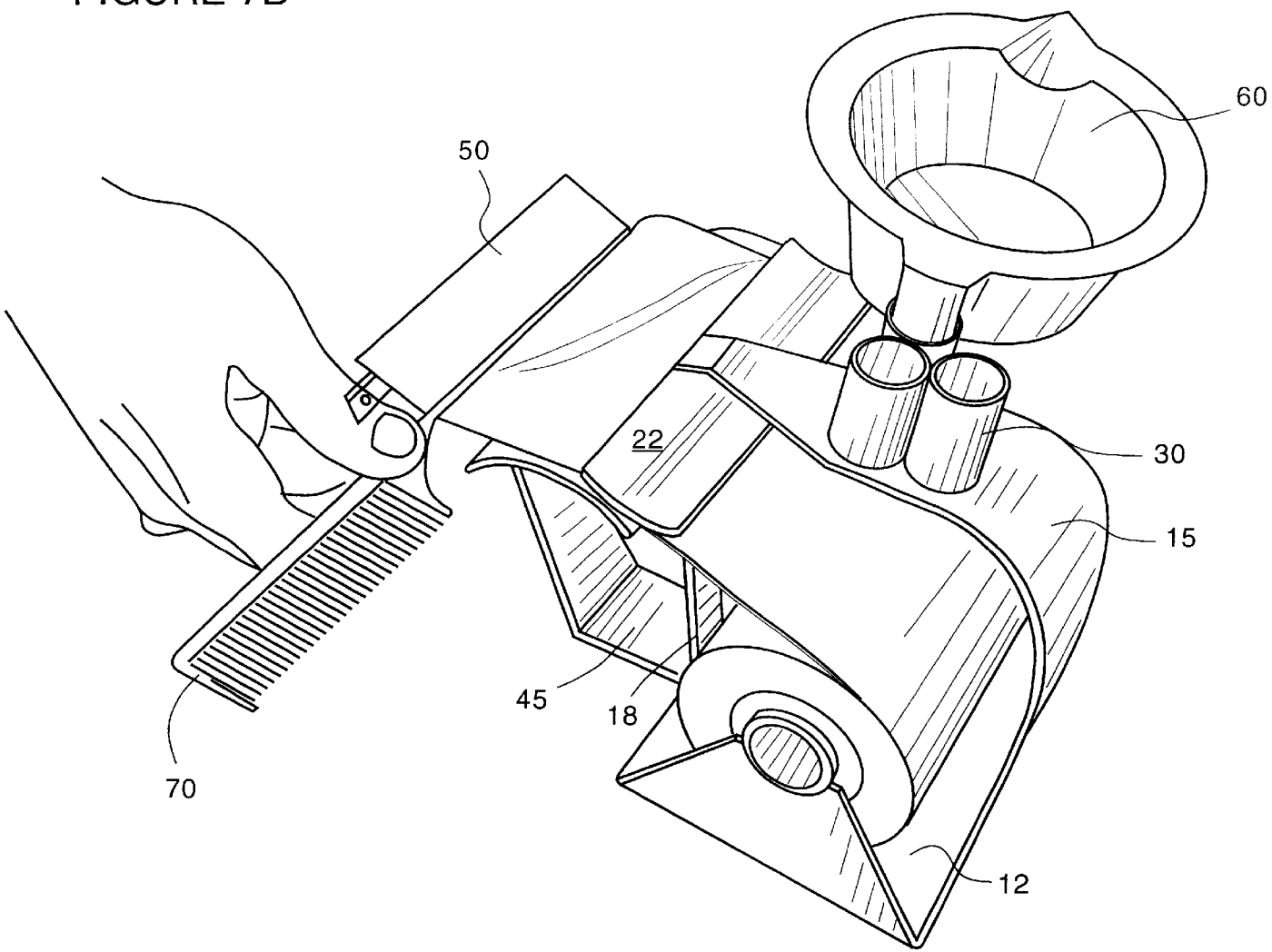
Figure 7C:
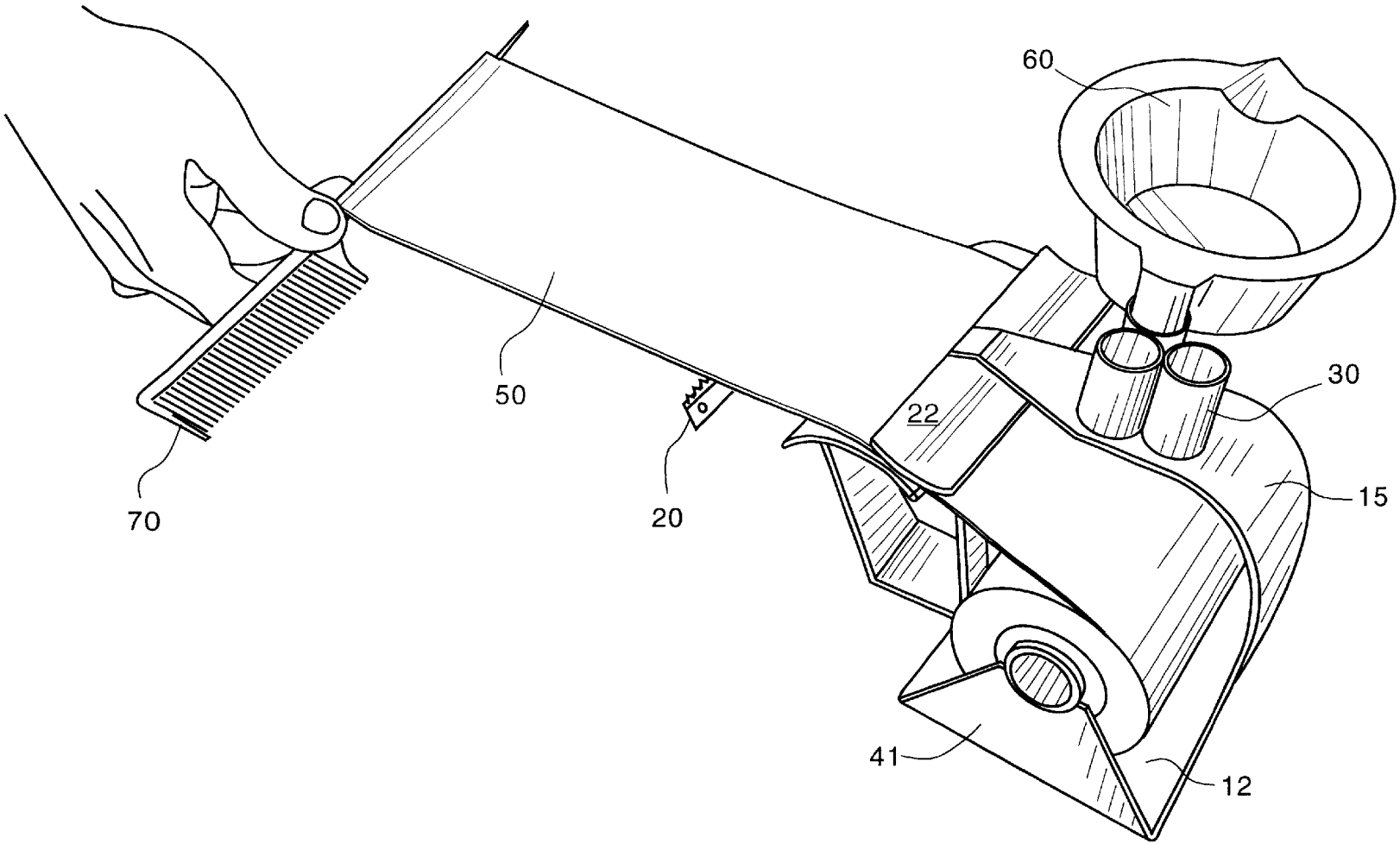

In operation, the support arm 15 is raised to expose the cylinder 14 (FIGS. 3 or 6), and a roll of metallic foil 50 or the like is placed on the cylinder 14, which in turn is secured to the base portion 12. The support arm 15 is then returned in its operating position as shown in FIG. 1. The free end of the metallic foil or other sheet material is threaded through the guide plates 21, 22 (when present). When the beautician is ready for a sheet of foil for placement under a lock of hair, the beautician grasps the free end of the foil, either directly with the hand or preferably with the tail 71 of a conventional rat tail comb 70, as shown in FIGS. 2, 7A and 9. When a rat tail comb is used, the beautician grasps the foil at a location about 0.5 to 1.5 inches, preferably about 1 inch, from the free end (FIGS. 2, 7B and 9). The beautician then pulls the foil 50 away from the roll to expose the desired length (FIGS. 7C and 10), and then imparts an upward force (in the case of the embodiment in FIGS. 1 and 8) to the foil 50 so as to cause the foil to engage against the severing device 20 and sever the foil 50 from the roll. A corresponding downward force would be applied in the case of the embodiment of FIGS. 4 or 6, and the stylist imparts a "flick of the wrist" action so that the wrist is turned 180° with the thumb now pointed downward in order to complete the fold of the foil about the comb.

The severed piece of foil 50 is now positioned in a folded manner (fold 51 shown in FIGS. 2, 5, 9 and 10) on the rat tail comb 70 in a manner conducive to be readily applied under the lock of hair with little or no further manipulation necessary. The fold 51 is preferable to provide additional strength to the upper edge of the foil 50 for proper placement under the lock of hair and against the scalp. As discussed above, facilitation of the fold can be accomplished with foil folding means 80 or detent mechanism 55. Once the foil 50 is so applied to the hair, the rat tail comb is removed while the foil is held in place and the hair is painted or otherwise treated.

The flexibility achieved through using the present device allows various lengths of sheet material to be severed, depending upon the length of the lock of hair being treated. In addition, a single sheet can be used to color or highlight a single lock of hair a plurality of different tones or colors; the end of the lock can be colored or highlighted with a first color, wrapped in the foil and thereby separated from the remaining portion of the lock, which can in turn then be colored or highlighted in a different tone or color, etc. The device enhances productivity, as the beutician never has to put down the comb, and the conventional method of cutting strips of foil at predetermined lengths is no longer needed.

What is claimed is:

1. A dispenser for sheet material, comprising a housing, a roll of sheet material rotatably secured in said housing, sheet material severing means attached to said housing for severing said sheet material, said severing means being positioned at an angle of greater than 0° and less than 90° with respect to horizontal, and a detent mechanism attached to said housing, said detent mechanism configured to fold said sheet material upon contact with said sheet material.

2. The dispenser of claim 1, further comprising guide means coupled to said housing for guiding said sheet material from said roll toward said severing means.

3. The dispenser of claim 2, wherein said guide means comprises a pair of plates extending from said housing and forming a nip therebetween.

4. The dispenser of claim 1, further comprising means coupled to said housing for supporting at least one bowl.

5. The dispenser of claim 1, further comprising a support arm having a first end movably coupled to said housing and a second end spaced from said first end and terminating in said severing means.

6. The dispenser of claim 1, further comprising foil folding means located between said roll of sheet material and said severing means.

7. The dispenser of claim 5, further comprising foil folding means coupled to said support arm, said foil folding means comprising a beveled plate terminating in a flange and forming a notch therebetween.

8. The dispenser of claim 1, wherein said sheet material is aluminum foil.

9. A dispenser for sheet material, comprising a housing, a roll of sheet material rotatably secured in said housing, sheet material severing means attached to said housing for severing said sheet material, said severing means being positioned at an angle of greater than 90° and less than 180° with respect to horizontal, guide means attached to said housing for guiding said sheet material from said roll toward said severing means, and a detent mechanism between said guide means and said severing means, said detent mechanism configured to fold said sheet material upon contact therewith.

10. The dispenser of claim 9, wherein said guide means comprises a pair of plates extending from said housing and forming a nip therebetween.

11. The dispenser of claim 9, further comprising means coupled to said housing for supporting at least one bowl.

12. The dispenser of claim 9, wherein said sheet material is aluminum foil.

13. A method of dispensing foil and applying said foil to the hair of an individual, comprising:

providing a dispenser for sheet material, comprising a housing, a roll of sheet material rotatably secured in said housing, and sheet material severing means attached to said housing for severing said sheet material;

grasping said sheet material with a rat tail comb;

pulling said sheet material in a direction away from said roll and past said severing means;

severing said sheet material from said roll by causing said sheet material to engage said severing means and tear; and contacting said sheet material with said hair.

14. The method of claim 13, wherein said severing means is positioned at an angle of greater than 0° and less than 90° with respect to horizontal.

15. The method of claim 13, wherein said severing means is positioned at an angle of greater than 90° and less than 180° with respect to horizontal.

16. The method of claim 13, further comprising causing said sheet material to fold about said rat tail comb after said sheet material is grasped with said rat tail comb.

17. The method of claim 16, wherein said dispenser further comprises guide means attached to said housing for guiding said sheet material from said roll toward said severing means, and a detent mechanism between said guide means and said severing means having an indentation, and wherein said sheet material is caused to fold about said rat tail comb by placing said rat tail comb over said sheet material and in said indentation of said detent mechanism.

18. The method of claim 16, wherein said dispenser further comprises foil folding means between said roll and said severing means, said folding means comprising a beveled plate terminating in a flange and forming a notch therebetween, and wherein said sheet material is caused to fold about said rat tail comb by bringing said rat tail comb and said grasped sheet material into contact with said notch.

* * * * *